US008875784B2

(12) United States Patent
Kuo et al.

(10) Patent No.: US 8,875,784 B2
(45) Date of Patent: Nov. 4, 2014

(54) ECONOMICAL CONSTRUCTION OF WELL SCREENS

(71) Applicant: Halliburton Energy Services, Inc., Houston, TX (US)

(72) Inventors: Nicholas A. Kuo, Dallas, TX (US); Gregory S. Cunningham, Grapevine, TX (US); Caleb T. Warren, Richardson, TX (US); Brandon T. Least, Dallas, TX (US); Michael L. Fripp, Carrollton, TX (US); Matthew E. Franklin, Lewisville, TX (US); Stephen M. Greci, McKinney, TX (US); Aaron J. Bonner, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/765,395

(22) Filed: Feb. 12, 2013

(65) Prior Publication Data

US 2013/0206406 A1 Aug. 15, 2013

Related U.S. Application Data

(63) Continuation of application No. 13/720,339, filed on Dec. 19, 2012.

(30) Foreign Application Priority Data

Feb. 13, 2012 (WO) ..... PCT/US2012/024897

(51) Int. Cl.

| | |
|---|---|
| ***E21B 43/00*** | (2006.01) |
| ***E21B 29/00*** | (2006.01) |
| ***E21B 43/08*** | (2006.01) |

(52) U.S. Cl.

CPC ..... *E21B 43/08* (2013.01); *E21B 43/084* (2013.01); *E21B 43/082* (2013.01)

USPC ..... 166/227; 166/228; 166/376

(58) Field of Classification Search

CPC ..... E21B 43/08; E21B 43/12; E21B 43/082; E21B 43/108; E21B 34/063

USPC ..... 166/227, 228, 229, 233, 236, 376, 278, 166/230, 23; 29/428

See application file for complete search history.

(56) References Cited

U.S. PATENT DOCUMENTS 1,473,644 A * 11/1923 Rodrigo, Sr. ..... 166/205
1,992,718 A * 2/1935 Records ..... 166/228

(Continued)

FOREIGN PATENT DOCUMENTS

EP 819831 A1 1/1998

OTHER PUBLICATIONS

Office Action issued Apr. 24, 2013 for U.S. Appl. No. 13/720,339, 16 pages.

(Continued)

*Primary Examiner* — Kenneth L Thompson
*Assistant Examiner* — Michael Wills, III
(74) *Attorney, Agent, or Firm* — Smith IP Services, P.C.

(57) ABSTRACT

A well screen for use in a subterranean well can include a loose filter media, a sandstone, a square weave mesh material, a foam, and/or a nonmetal mesh material. A method of installing a well screen in a subterranean well can include dispersing a material in a filter media of the well screen, after the well screen has been installed in the well, thereby permitting a fluid to flow through the filter media. A method of constructing a well screen can include positioning a loose filter media in an annular space between a base pipe and a shroud, so that the filter media filters fluid which flows through a wall of the base pipe.

43 Claims, 5 Drawing Sheets

(56) References Cited

U.S. PATENT DOCUMENTS

| | | | | | |
|---|---|---|---|---|---|
| 2,391,609 | A * | 12/1945 | Wright | 166/228 |
| 2,392,263 | A * | 1/1946 | Records | 427/240 |
| 2,905,251 | A * | 9/1959 | Church | 166/228 |
| 3,014,530 | A * | 12/1961 | Harvey et al. | 166/293 |
| 3,216,497 | A | 11/1965 | Howard et al. | |
| 3,357,564 | A * | 12/1967 | Medford, Jr. et al. | 210/266 |
| 3,543,854 | A * | 12/1970 | Degen | 166/228 |
| 4,202,411 | A | 5/1980 | Sharp et al. | |
| 4,487,259 | A * | 12/1984 | McMichael, Jr. | 166/228 |
| 4,821,800 | A * | 4/1989 | Scott et al. | 166/228 |
| 5,113,941 | A * | 5/1992 | Donovan | 166/250.01 |
| 5,115,864 | A | 5/1992 | Gaidry et al. | |
| 5,150,753 | A * | 9/1992 | Gaidry et al. | 166/278 |
| 5,165,476 | A | 11/1992 | Jones | |
| 5,355,956 | A * | 10/1994 | Restarick | 166/296 |
| 5,855,242 | A * | 1/1999 | Johnson | 166/236 |
| 5,881,812 | A * | 3/1999 | Malbrel et al. | 166/278 |
| 5,979,551 | A * | 11/1999 | Uban et al. | 166/233 |
| 6,062,307 | A * | 5/2000 | Hamid et al. | 166/51 |
| 6,390,195 | B1 | 5/2002 | Nguyen et al. | |
| 6,394,185 | B1 | 5/2002 | Constien | |
| 6,513,588 | B1 | 2/2003 | Metcalfe | |
| 6,543,545 | B1 | 4/2003 | Chatterji et al. | |
| 6,581,683 | B2 | 6/2003 | Ohanesian | |
| 6,766,862 | B2 | 7/2004 | Chatterji et al. | |
| 6,769,484 | B2 | 8/2004 | Longmore | |
| 6,831,044 | B2 | 12/2004 | Constien | |
| 6,969,469 | B1 * | 11/2005 | Xie | 210/807 |
| 7,048,048 | B2 | 5/2006 | Nguyen et al. | |
| 7,413,022 | B2 * | 8/2008 | Broome et al. | 166/386 |
| 7,451,815 | B2 | 11/2008 | Hailey, Jr. | |
| 7,552,770 | B2 * | 6/2009 | Braden | 166/278 |
| 7,581,586 | B2 * | 9/2009 | Russell | 166/229 |
| 7,784,543 | B2 * | 8/2010 | Johnson | 166/296 |
| 7,836,952 | B2 * | 11/2010 | Fripp | 166/280.1 |
| 7,942,206 | B2 | 5/2011 | Huang et al. | |
| 8,061,388 | B1 * | 11/2011 | O'Brien et al. | 138/89 |
| 8,215,385 | B2 * | 7/2012 | Cooke, Jr. | 166/227 |
| 8,336,619 | B2 * | 12/2012 | Nutley et al. | 166/229 |
| 8,424,609 | B2 * | 4/2013 | Duphorne et al. | 166/373 |
| 8,430,174 | B2 * | 4/2013 | Holderman et al. | 166/376 |
| 8,490,690 | B2 * | 7/2013 | Lopez | 166/205 |
| 2004/0231845 | A1 | 11/2004 | Cooke, Jr. | |
| 2005/0056425 | A1 | 3/2005 | Grigsby et al. | |
| 2006/0037752 | A1 * | 2/2006 | Penno et al. | 166/278 |
| 2006/0185849 | A1 * | 8/2006 | Edwards et al. | 166/296 |
| 2006/0205605 | A1 * | 9/2006 | Dessinges et al. | 507/211 |
| 2006/0272814 | A1 | 12/2006 | Broome et al. | |
| 2007/0012444 | A1 * | 1/2007 | Horgan et al. | 166/278 |
| 2007/0190880 | A1 | 8/2007 | Dubrow et al. | |
| 2008/0035330 | A1 * | 2/2008 | Richards | 166/228 |
| 2008/0142222 | A1 | 6/2008 | Howard et al. | |
| 2010/0012323 | A1 | 1/2010 | Holmes et al. | |
| 2010/0258301 | A1 * | 10/2010 | Bonner et al. | 166/230 |
| 2011/0011577 | A1 * | 1/2011 | Dusterhoft et al. | 166/212 |
| 2011/0073296 | A1 * | 3/2011 | Richard et al. | 166/56 |
| 2011/0162837 | A1 | 7/2011 | O'Malley et al. | |
| 2011/0253375 | A1 | 10/2011 | Jamaluddin et al. | |
| 2011/0265990 | A1 * | 11/2011 | Augustine et al. | 166/230 |
| 2012/0067587 | A1 | 3/2012 | Agrawal et al. | |
| 2012/0145389 | A1 | 6/2012 | Fitzpatrick, Jr. | |
| 2012/0186819 | A1 * | 7/2012 | Dagenais et al. | 166/310 |
| 2013/0199798 | A1 | 8/2013 | Seth et al. | |

OTHER PUBLICATIONS

International Search Report with Written Opinion issued Oct. 25, 2012 for PCT Patent Application No. PCT/US12/024897, 17 pages.

International Search Report with Written Opinion issued Nov. 20, 2012 for PCT Patent Application No. PCT/US12/030182, 12 pages.

Andrew P. Limmack; "Thermal Conduction of Nano-Diamond Dispersed Polyurethane Nano-Composites", experimental paper, accessed Feb. 22, 2012, 9 pages.

Halliburton Energy Services, Inc.; Enhanced Low Profile (ELP) Prepack Screens, H08457, dated Jun. 2011, 2 pages.

Halliburton Energy Services, Inc.: "Dual-Screen Prepack Screens", H08458, dated Jun. 2011, 2 pages.

A.H. El-Hag, et al.; "Erosion Resistance of Nano-filled Silicone Rubber", IEEE article, dated Apr. 25, 2005, 7 pages.

Karen Boman; "O&G Companies Pushing E&P Limits with Nanotechnology", Free Republic paper, dated Nov. 14, 2011, 2 pages.

Specification and Drawings for U.S. Appl. No. 14/517,672, filed Dec. 19, 2012, 44 pages.

Office Action issued Nov. 18, 2013 for U.S. Appl. No. 13/720,339, 16 pages.

Office Action issued Feb. 24, 2014 for U.S. Appl. No. 13/720,339, 12 pages.

Specification and Drawings for U.S. Appl. No. 14/370,461, filed Jul. 2, 2014, 18 pages.

Office Action issued May 29, 2014 for U.S. Appl. No. 13/720,339, 13 pages.

* cited by examiner

ECONOMICAL CONSTRUCTION OF WELL SCREENS

CROSS-REFERENCE TO RELATED APPLICATION(S)

This application is a continuation of U.S. application Ser. no. 13/720,339 filed on 19 Dec. 2012, which claims the benefit under 35 USC §119 of the filing date of International Application Serial No. PCT/US12/24897, filed 13 Feb. 2012. The entire disclosures of these prior applications are incorporated herein by this reference.

BACKGROUND

This disclosure relates generally to equipment utilized and operations performed in conjunction with a subterranean well and, in one example described below, more particularly provides for economical construction of well screens.

Well screens are used to filter fluid produced from earth formations. Well screens remove sand, fines, debris, etc., from the fluid. It will be appreciated that improvements are continually needed in the art of constructing well screens.

SUMMARY

In this disclosure, well screen constructions are provided which bring improvements to the art. One example is described below in which a loose material is used as a filtering media. Another example is described below in which a well construction uses relatively inexpensive unconventional filtering media, such as sandstone, square weave wire mesh, foam, fiber wraps, proppant, stamped metal pieces, etc.

A well screen for use in a subterranean well is described below. In one example, the well screen can include a generally tubular base pipe and a loose filter media proximate the base pipe.

In another example, the well screen can include a sandstone which filters fluid that flows between an interior and an exterior of the base pipe.

In another example, the well screen can include at least one filter media made of a square weave mesh material which filters fluid that flows between an interior and an exterior of the base pipe.

In another example, the well screen can include a filter media comprising a fiber coil which filters fluid that flows between an interior and an exterior of the base pipe.

In another example, the well screen can include a filter media comprising a foam which filters fluid that flows between an interior and an exterior of the base pipe.

In yet another example, the well screen can include a filter media comprising a nonmetal mesh material which filters fluid that flows between an interior and an exterior of the base pipe.

A method of installing a well screen in a subterranean well is also described below. In one example, the method can include dispersing a material in a filter media of the well screen, after the well screen has been installed in the well, thereby permitting a fluid to flow through the filter media.

A method of constructing a well screen is also described below. In one example, the method can include positioning a loose filter media in an annular space between a base pipe and a shroud, so that the filter media filters fluid which flows through a wall of the base pipe.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
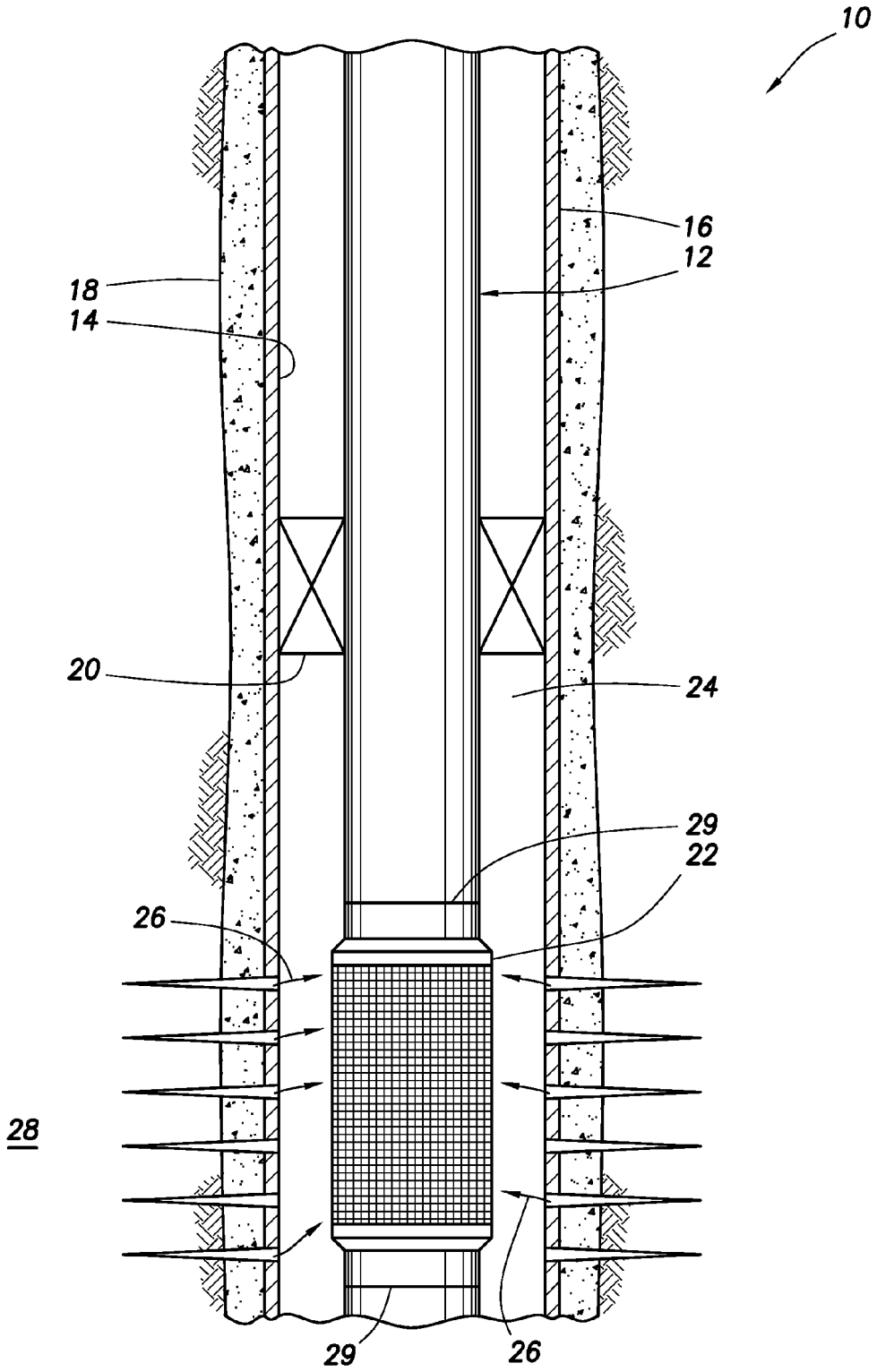
FIG. 1 is a representative partially cross-sectional view of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of this disclosure's principles in practice. Many other examples are possible, and so the scope of this disclosure is not limited at all to any of the details of the system 10 and method described herein.

As depicted in FIG. 1, a tubular string 12 (such as a production tubing string, a testing work string, a completion string, a gravel packing and/or stimulation string, etc.) is installed in a wellbore 14 lined with casing 16 and cement 18. The tubular string 12 in this example includes a packer 20 and a well screen 22.

The packer 20 isolates a portion of an annulus 24 formed radially between the tubular string 12 and the wellbore 14. The well screen 22 filters fluid 26 which flows into the tubular string 12 from the annulus 24 (and from an earth formation 28 into the annulus). The well screen 22 in this example includes end connections 29 (such as internally or externally formed threads, seals, etc.) for interconnecting the well screen in the tubular string 12.

The tubular string 12 may be continuous or segmented, and made of metal and/or nonmetal material. The tubular string 12 does not necessarily include the packer 20 or any other particular item(s) of equipment. Indeed, the tubular string 12 is not even necessary in keeping with the principles of this disclosure.

It also is not necessary for the wellbore 14 to be vertical as depicted in FIG. 1, for the wellbore to be lined with casing 14 or cement 16, for the packer 20 to be used, for the fluid 26 to flow from the formation 28 into the tubular string 12, etc. Therefore, it will be appreciated that the details of the system 10 and method do not limit the scope of this disclosure in any way.

Several examples of the well screen 22 are described in more detail below. Each of the examples described below can be constructed conveniently, rapidly and economically, thereby improving a cost efficiency of the well system 10 and method, while effectively filtering the fluid 26.

Figure 2A:
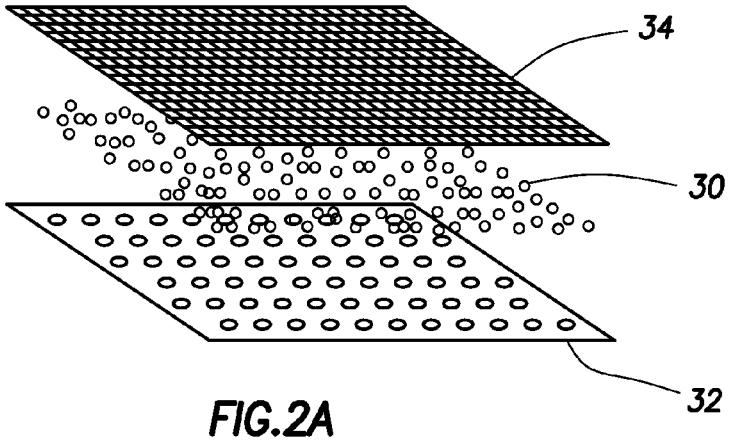
FIGS. 2A-C representatively illustrate steps in a method of constructing a well screen, which well screen and method can embody principles of this disclosure.
Figure 2B:
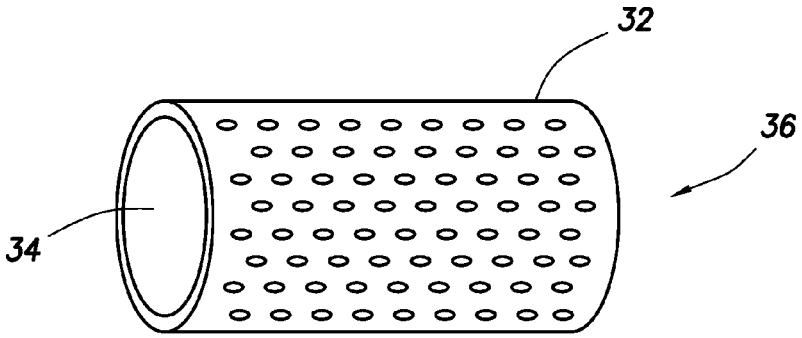
Figure 2C:
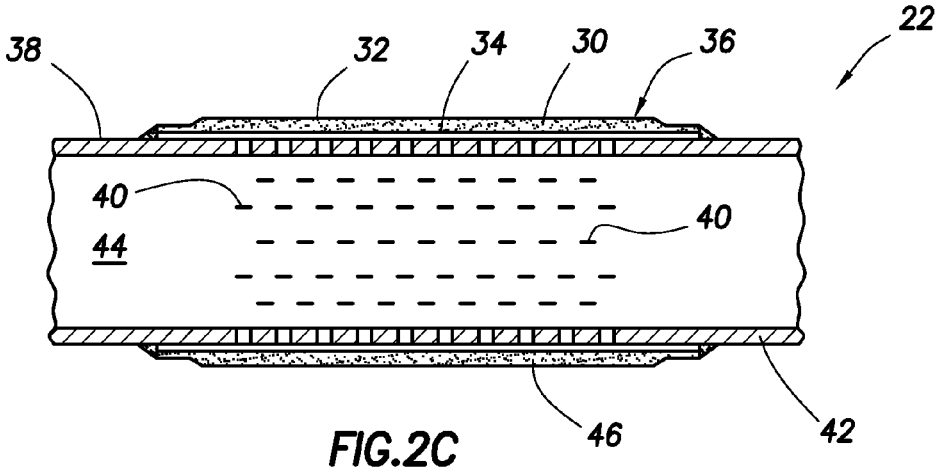

In FIGS. 2A-C, a method of constructing one example of the well screen 22 is representatively illustrated. In this example, a loose filter media 30 is initially positioned between a shroud 32 and a drainage layer 34, with the shroud and drainage layer being in the form of flat sheets, as illustrated in FIG. 2A.

The term "loose" is used to describe a material which comprises solid matter, but which is flowable (such as, granular or particulate material, aggregate, etc.). The solid matter could be mixed with a liquid or other nonsolid matter, for example, to enhance the process of conveying the material, etc.

The shroud 32 serves to contain and protect the filter media 30 during installation and subsequent use in the well. The shroud 32 is depicted in FIG. 2A as being a perforated sheet. The shroud 32 may be made of a metal or a nonmetal material.

It is not necessary for the shroud 32 to comprise a perforated sheet. In other examples, the shroud 32 could comprise a woven mesh material or another type of material. In addition, use of the shroud is not necessary in the screen 22.

The drainage layer 34 facilitates flow of the fluid 26 from the filter media 30, by providing flow paths for the fluid. The drainage layer 34 can also serve to contain the filter media 30.

The drainage layer 34 is depicted in FIG. 2A as being made of a woven mesh material. The mesh material may comprise a metal or nonmetal.

It is not necessary for the drainage layer 34 to comprise a woven mesh material. In other examples, the drainage layer 34 could comprise a slotted sheet, a paper material, a foam or another type of material. In addition, use of the drainage layer is not necessary in the screen 22.

In FIG. 2B, the shroud 32 and drainage layer 34, with the loose filter media 30 between them (although not visible in FIG. 2B), are rolled into a cylindrical shape in preparation for installing the resulting screen jacket 36 on a base pipe 38 (see FIG. 2C).

In FIG. 2C, the screen 22 is formed by securing the screen jacket 36 on the base pipe 38, for example, by welding, adhesively bonding, etc. The ends of the screen jacket 36 may be crimped to retain the loose filter media 30 between the shroud 32 and the drainage layer 34 prior to the securing step.

It is not necessary for the steps described above to be performed in constructing the well screen 22. In other examples, the annular space 46 could be formed, and then the loose filter media 30 could be poured into the annular space. Similarly, it is not necessary for the screen jacket 36 to begin as a flat assembly, then to be rolled into a cylindrical shape, and then to be secured onto the base pipe 38.

In some examples, differences in thermal coefficients of expansion can be used to compress the filter media 30. The shroud 32 could have a lower coefficient of thermal expansion as compared to the base pipe 38, so that at downhole temperatures, the base pipe expands radially outward at a rate greater than that of the shroud, thereby radially compressing the filter media 30 (whether or not the drainage layer 34 is used). The shroud 32 could have a lower coefficient of thermal expansion as compared to the drainage layer 34, so that at downhole temperatures, the drainage layer expands radially outward at a rate greater than that of the shroud, thereby radially compressing the filter media 30 between the shroud and the drainage layer.

Note that the base pipe 38 in this example has multiple slots 40 extending through a wall 42 of the base pipe. The slots 40 permit the fluid 26 to flow into an interior flow passage 44 extending longitudinally through the base pipe 38. When interconnected in the tubular string 12, the flow passage 44 also extends longitudinally through the tubular string.

If the drainage layer 34 is not used, the slots 40 may be dimensioned so that the loose filter media 30 cannot pass through the slots. Of course, openings other than slots may be used in the base pipe 38, if desired (such as circular holes, etc.).

As depicted in FIG. 2C, the loose filter media 30 is contained in an annular space 46. In this example, the annular space 46 is external to the base pipe 38, but in other examples the annular space could be internal to the base pipe.

The base pipe 38 may be a separate generally tubular element (with end connections 29 as illustrated in FIG. 1), or the base pipe may be a section of a continuous tubular string. The base pipe 38 may be made of a metal or nonmetal material.

Note that, for illustrative clarity, a radial gap appears between the drainage layer 34 and the base pipe 38, and between the layers 32, 34 at their crimped ends. In actual practice, these gaps can be eliminated.

Figure 3:
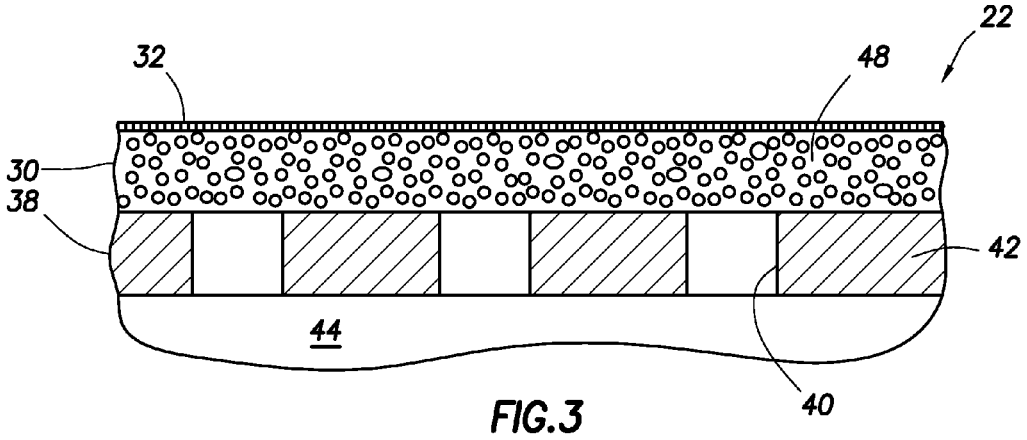
FIGS. 3-10 are representative cross-sectional views of additional examples of the well screen.

Referring additionally now to FIG. 3, an enlarged scale cross-sectional view of a portion of the well screen 22 is representatively illustrated. In this example, the drainage layer 34 is not used, and the filter media 30 comprises a loose aggregate material 48, such as sand, etc., of various dimensions. Preferably, the aggregate material 48 is dimensioned so that it will exclude undesired sand, fines, debris, etc., from the fluid 26 as it flows through the filter media 30.

Figure 4:
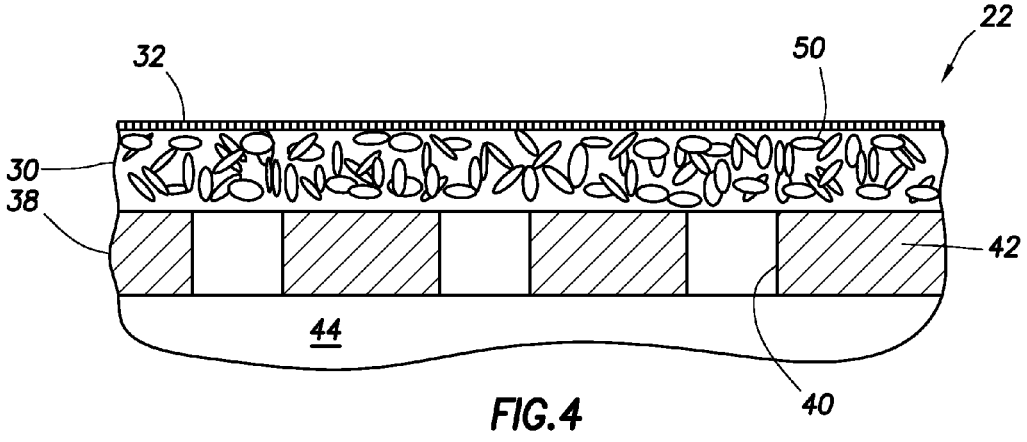

In FIG. 4, the filter media 30 comprises interlocking pieces 50 which randomly engage each other to form the filter media. The pieces 50 could be metal pieces which are stamped or otherwise formed, so that they have interlocking shapes.

Nonmetal material may be used for the pieces 50, if desired. For example, rubber (e.g., from shredded tires, etc.), plastic and/or composite material may be used for the filter media 30.

Suitable interlocking shapes are described in U.S. Pat. Nos. 8,091,637 and 7,836,952, the entire disclosures of which are incorporated herein by this reference. These patents describe a concept of using prolate-shaped particles. The prolate particles will lock together, and will filter material, while maintaining substantial porosity.

Note that, in the FIG. 4 example, the shapes of the pieces are preferably such that a locking pattern between the pieces 50 is random. The shapes of the pieces 50 are not necessarily random, but the locking pattern is preferably random.

Figure 5:
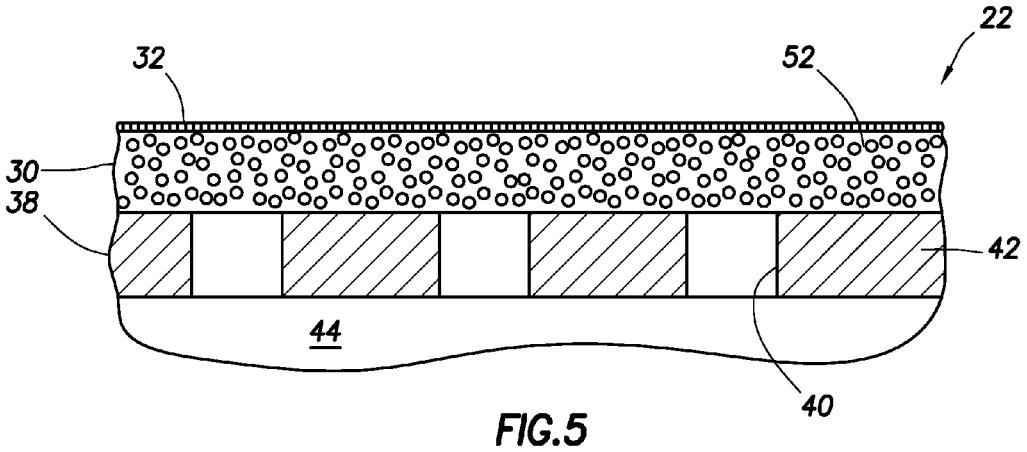

In FIG. 5, the filter media 30 comprises a proppant 52. The proppant 52 could comprise sand, ceramic beads, glass spheres, or any other type of material used for propping fractures in earth formations.

Figure 6:
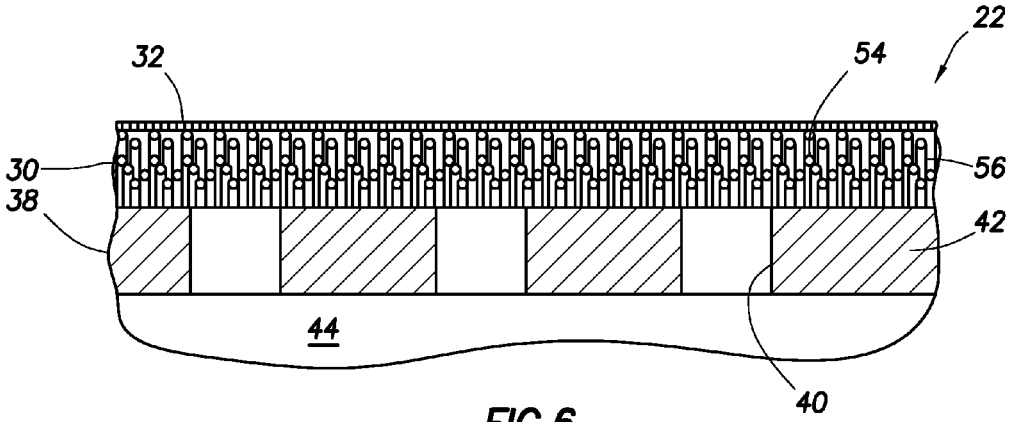

In FIG. 6, the filter media 30 is not loose, but instead comprises a fiber coil 54. The fiber coil 54 could be formed prior to installing it on the base pipe 38, or the coil could be formed by wrapping one or more fibers 56 (such as, a glass fiber, a carbon fiber, or another type of fiber) around the base pipe once or multiple times. For protection from erosion, the fiber 56 can be coated with ceramic or another erosion resistant material.

In some examples, the fibers 56 can comprise materials such as metal, plastic and/or organic material. Any type of material and any combination of one or more materials may be used in the fibers 56.

Note that, for illustrative clarity, gaps appear between the fibers 56 in FIG. 6. In actual practice, these gaps can be eliminated.

Figure 7:
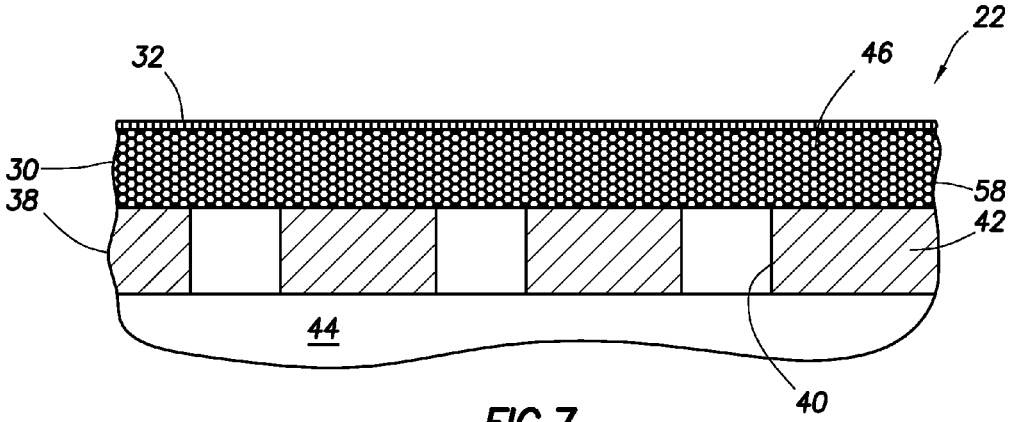

In FIG. 7, the filter media 30 comprises a foam 58. The foam 58 may be an expanded open cell metal foam, or another type of foam. The foam 58 may be made of plastic or another nonmetal material. The foam 58 may be expanded within the annular space 46 between the shroud 32 and the base pipe 38, or the foam may be separately formed and then installed on the base pipe.

Figure 8:
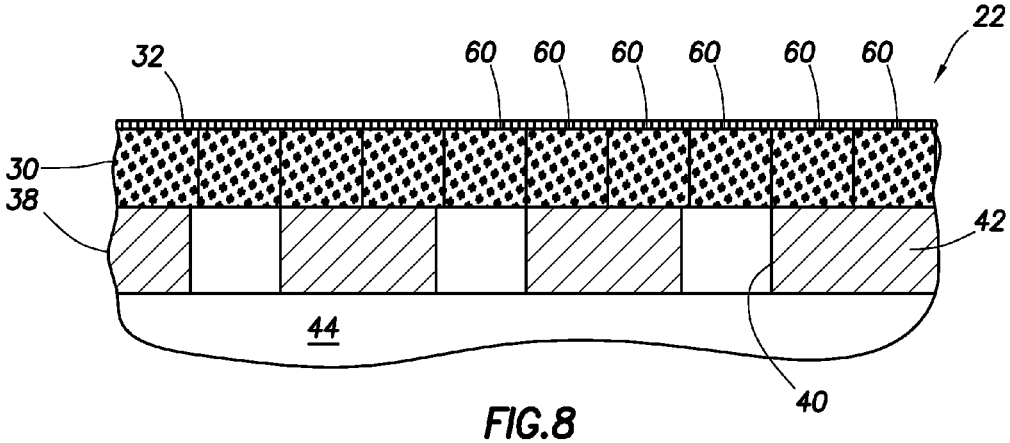

In FIG. 8, the filter media 30 comprises multiple annular-shaped rings of stone 60. The stone 60 is preferably selected so that it has a stable form under flowing conditions, and so that it filters undesired sand, fines and debris from the fluid 26. Sandstone and/or another type of porous stone may be used for the stone 60.

Figure 9:
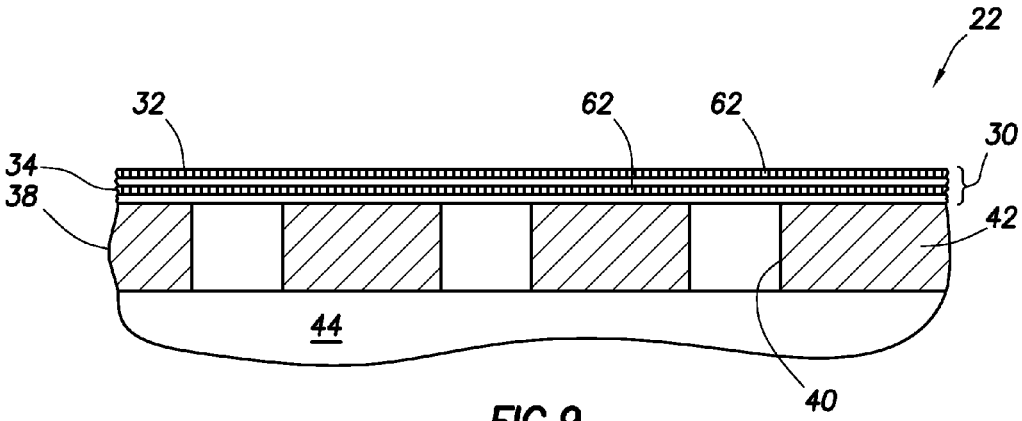

In FIG. 9, the filter media 30 comprises the shroud 32 and drainage layer 34, each of which is made of a square weave woven mesh material 62. The shroud 32 mesh material 62 may have a different dimension or size relative to the drainage layer 34 mesh material (e.g., a tighter or more open weave, etc.). The mesh material may be metal or nonmetal (such as a synthetic material).

In one example, the shroud 32 mesh material may be offset relative to the drainage layer 34 mesh material. The shroud 32 mesh material could be angularly offset (e.g., rotated 45 degrees, etc.) relative to the drainage layer 34 mesh material. Such offsets can affect how the filter media 30 excludes sand, fines, debris, etc. from the fluid 26.

A nonmetal mesh material (such as a synthetic material) could be used for any of the mesh materials described above (e.g., in the filter media 30, the shroud 32, the drainage layer 34, etc.). A glue or porous coating could be applied to the mesh material to secure it to the base pipe 38. In one example, a porous coating could be used to secure a circumferential end of the mesh material to another circumferential end of the mesh material after the material has been wrapped about the base pipe 38 (if only one wrap is used), or to another portion of the mesh material (e.g., if multiple wraps are used).

The porous coating could be similar to titanium coatings used in biomedical applications, for example, coatings comprising small non-spherical beads that leave pores to allow bone ingrowth and fusing with a coated surgical implant, etc. Examples include Ti Porous Coating marketed by APS Materials, Inc. of Dayton, Ohio USA, and 3DMatrix Porous Coating marketed by DJO Surgical of Austin, Tex. USA.

Any shape of the beads (e.g., spherical or non-spherical, etc.) may be used, and any material may be used in the beads. For example, the beads may be made of titanium, a CoCr alloy, a nonmetal, etc.

Pore size and/or bead size in the porous coating can be varied as needed to achieve a desired porosity for optimal filtration in the filter media 30. The porous coating could be applied by plasma spray, for example.

Figure 10:
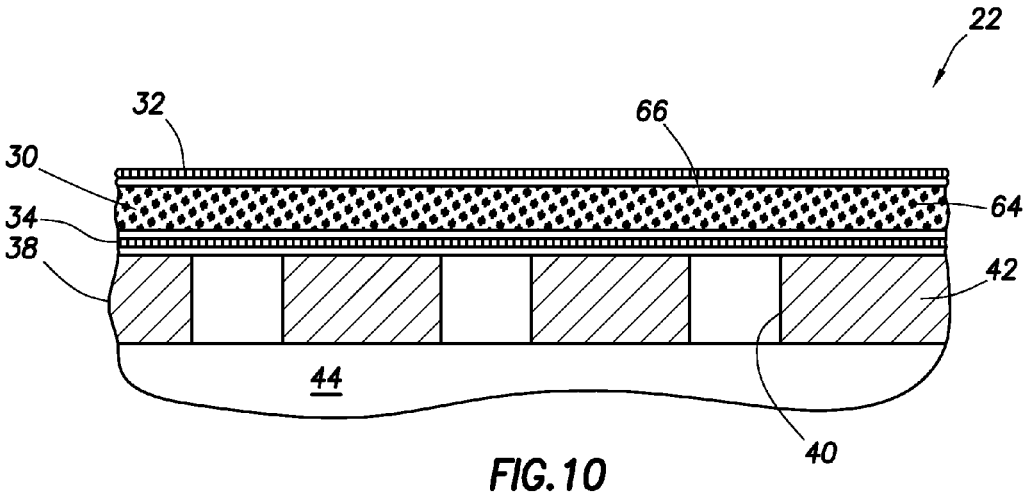

In FIG. 10, the filter media 30 comprises sand 64 which has been consolidated by use of a binder or other dispersible material 66 (such as wax, polylactic acid, anhydrous boron, salt (e.g., NaCl or MgO), sugar, etc.). The material 66 can serve any of several purposes, for example, holding the sand 64 (or other loose material) together for convenient handling during the process of constructing the well screen 22, preventing flow through the wall 42 of the base pipe 38 until after the well screen 22 has been installed in a well, serving as a pressure barrier, preventing plugging of the filter media 30, etc.

After installation of the well screen 22 in the well, the dispersible material 66 can be dispersed by any technique. For example, the material 66 could be melted, dissolved, sublimated, etc.

If polylactic acid is used as the material 66, then water at elevated temperature can dissolve the polylactic acid. If wax is used as the material 66, then the wax can melt when elevated well temperatures are encountered during or after installation of the well screen 22 in the well. If anhydrous boron is used as the material 66, then the anhydrous boron will disperse upon contact with water. In other examples, acid could be used to dissolve the material 66.

In one example, the drainage layer 34 could comprise a paper material. Pores in the paper material could be initially plugged with the dispersible material 66. The paper could be glued or otherwise secured to the base pipe 38 (e.g., using a porous coating).

The dispersible material 66 could also be used to seal off pores, or serve as a binder, in any of the other filter media 30 described above and/or depicted in FIGS. 2A-9. Thus, the material 66 could initially be present in the pores of the foam 58 of FIG. 7, the material 66 could bind together the interlocking pieces 50 of FIG. 4, etc.

Note that, for illustrative clarity, radial gaps appear between the drainage layer 34 and the base pipe 38, between the layers 32, 34, and between the filter media 30 and the layers 32, 34, in FIGS. 9 & 10. In actual practice, these gaps can be eliminated.

It may now be fully appreciated that the above disclosure provides significant advancements to the art of constructing well screens. In examples described above, well screens 22 are constructed using relatively low cost materials and efficient manufacturing methods.

A well screen 22 for use in a subterranean well is described above. In one example, the well screen 22 can include a generally tubular base pipe 38, and a loose filter media 30 proximate the base pipe 38.

The loose filter media 30 may be retained in an annular space 46 radially between the base pipe 38 and a shroud 32.

The loose filter media 30 can comprise sand 64, proppant 52, pieces 50 of metal, sandstone 60, rubber, a granular material (e.g., the sand, proppant, aggregate material, etc.), randomly interlocking shapes (e.g., on the pieces 50), an aggregate material 48, and/or a composite material.

The base pipe 38 may have a wall 42 which separates an interior from an exterior of the base pipe 38. The loose filter media 30 may filter fluid 26 which flows through the base pipe wall 42.

Also described above is a well screen 22 which, in one example, can include a generally tubular base pipe 38 and a stone 60 which filters fluid 26 that flows between an interior and an exterior of the base pipe 38.

The stone 60 may be annular shaped.

The stone 60 can comprise multiple sandstone rings.

The stone 60 may circumscribe the base pipe 38.

The stone 60 may be positioned in an annular space 46 formed radially between the base pipe 38 and a shroud 32.

The stone 60 may filter the fluid 26 which flows through the base pipe wall 42.

In another example, the well screen 22 can include at least a first filter media (such as the shroud 32) made of a square weave mesh material 62 which filters fluid 26 that flows between an interior and an exterior of the base pipe 38.

The first filter media 32 may be glued to the base pipe 38, and/or may be coated with a resin. A second filter media may also be glued to the base pipe 38 and/or coated with a resin.

The well screen 22 can also include a second square weave mesh material filter media (e.g., the drainage layer 34) which filters the fluid 26. The second filter media 34 may be offset (e.g., angularly, laterally and/or longitudinally offset) relative to the first filter media 32.

The well screen 22 can also include a loose second filter media 30 positioned in an annular space 46 between the first filter media 32 and the base pipe 38.

The first filter media 32 may filter the fluid 46 which flows through the base pipe wall 42.

In another example, a well screen 22 can include a fiber coil 54 which filters fluid 26 that flows between an interior and an exterior of the base pipe 38.

The fiber coil 54 may comprise a carbon fiber 56, a glass fiber 56, and/or a ceramic coated fiber 56. Other materials (such as, metal, plastic, organic materials, etc.) may be used in other examples.

The fiber coil 54 may comprise multiple wraps of a fiber 56 about the base pipe 38.

The fiber coil 54 can be positioned in an annular space 46 formed radially between the base pipe 38 and a shroud 32.

In another example, the well screen can include a filter media 30 comprising a foam 58 which filters fluid 26 that flows between an interior and an exterior of the base pipe 38.

The foam 58 may be positioned in an annular space 46 formed radially between the base pipe 38 and a shroud 32.

The foam 58 can comprise a metal foam, a plastic foam, and/or an open cell foam.

A dispersible material 66 may fill pores in the foam 58. The dispersible material 66 may comprise polylactic acid, a wax, and/or a dissolvable material.

In another example, a well screen 22 can include a filter media 30 comprising a nonmetal mesh material 62 which filters fluid 26 that flows between an interior and an exterior of the base pipe 38.

The mesh material 62 may be positioned in an annular space 46 formed radially between the base pipe 38 and a shroud 32. For example, the drainage layer 34 can be made of the nonmetal mesh material 62.

The mesh material 62 can be coated with a porous coating.

The mesh material 62 may be wrapped exteriorly about the base pipe 38.

The mesh material 62 may be wrapped multiple times about the base pipe 38.

The mesh material 62 may comprise a synthetic material.

A seam at a circumferential end of the mesh material 62 may be secured (e.g., to the base pipe 38, to another portion of the mesh material, etc.) with a porous coating.

A method of installing a well screen 22 in a subterranean well can include dispersing a material 66 in a filter media 30 of the well screen 22, after the well screen 22 has been installed in the well, thereby permitting a fluid 26 to flow through the filter media 30.

The filter media 30 may comprise a loose filter media.

The filter media 30 may comprise a sandstone 60, sand 64, proppant 52, a fiber coil 54, and/or a foam 58. The foam 58 may comprise a metal foam or a plastic foam.

The filter media 30 may comprise a square weave mesh material 62, a nonmetal mesh material 62, pieces 50 of metal or rubber, interlocking shapes, an aggregate material 48, a composite material, a paper material, and/or a granular material.

The dispersing material 66 may comprise a wax, anhydrous boron, polylactic acid, a salt, and/or a sugar.

A method of constructing a well screen 22 can include positioning a loose filter media 30 in an annular space 46 between a base pipe 38 and a shroud 32, so that the filter media 30 filters fluid 26 which flows through a wall 42 of the base pipe 38.

The method can include positioning the loose filter media 30 between the shroud 32 and a drainage layer 34.

The method can include forming the shroud 32, the loose filter media 30 and the drainage layer 34 into a cylindrical shape. Positioning the loose filter media 30 in the annular space 46 can include positioning the shroud 32, the loose filter media 30 and the shroud 32 on the base pipe 38 after the forming.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A well screen for use in a subterranean well, the well screen comprising:

a generally tubular base pipe including at least one opening through a wall of the base pipe;

a drainage layer radially surrounding the base pipe;

a perforated shroud radially surrounding the drainage layer and forming an exterior of the well screen; and a loose filter media filling an annular space defined by an outer surface of the drainage layer and an inner surface of the shroud, wherein the drainage layer, shroud, and loose filter media collectively form a screen jacket, wherein the loose filter media is placed in the annular space prior to installation of the screen jacket on the base pipe, wherein the ends of the screen jacket are crimped thereby retaining the loose filter media between the shroud and the drainage layer prior to installation of the screen jacket on the base pipe, and wherein the loose filter media filters fluid which flows through the perforated shroud and the opening.

2. The well screen of claim 1, wherein the screen jacket is secured to the base pipe by at least one of welding and adhesive bonding.

3. The well screen of claim 1, wherein the loose filter media comprises sand.

4. The well screen of claim 1, wherein the loose filter media comprises proppant.

5. The well screen of claim 1, wherein the loose filter media comprises pieces of metal.

6. The well screen of claim 1, wherein the loose filter media comprises stone.

7. The well screen of claim 1, wherein the loose filter media comprises rubber.

8. The well screen of claim 1, wherein the loose filter media comprises a granular material.

9. The well screen of claim 1, wherein the loose filter media comprises interlocking shapes.

10. The well screen of claim 1, wherein the loose filter media comprises an aggregate material.

11. The well screen of claim 1, wherein the loose filter media comprises a composite material.

12. A method of installing a well screen in a subterranean well, the method comprising:

disposing a material in a loose filter media which forms an annular filter layer between a perforated shroud and a drainage layer, wherein the loose filter media is flowable;

then installing the well screen in the well; and then dispersing the material disposed in the loose filter media, thereby permitting a fluid to flow through the loose filter media into a supporting base pipe.

13. The method of claim 12, wherein the filter media comprises a stone.

14. The method of claim 12, wherein the filter media comprises sand.

15. The method of claim 12, wherein the filter media comprises proppant.

16. The method of claim 12, wherein the filter media comprises pieces of metal.

17. The method of claim 12, wherein the filter media comprises rubber.

18. The method of claim 12, wherein the filter media comprises interlocking shapes.

19. The method of claim 12, wherein the filter media comprises an aggregate material.

20. The method of claim 12, wherein the filter media comprises a composite material.

21. The method of claim 12, wherein the drainage layer comprises a paper material.

22. The method of claim 12, wherein the filter media comprises a granular material.

23. The method of claim 12, wherein the material comprises wax.

24. The method of claim 12, wherein the material comprises polylactic acid.

25. The method of claim 12, wherein the material comprises anhydrous boron.

26. The method of claim 12, wherein the material comprises salt.

27. The method of claim 12, wherein the material comprises sugar.

28. A method of constructing a well screen, the method comprising:

positioning a loose filter media in an annular space between a base pipe and a shroud, so that the loose filter media filters fluid which flows through a wall of the base pipe, wherein the loose filter media is compressed in response to a temperature increase.

29. The method of claim 28, further comprising positioning the loose filter media between the shroud and a drainage layer.

30. The method of claim 29, further comprising forming the shroud, the loose filter media and the drainage layer into a cylindrical shape.

31. The method of claim 30, wherein positioning the loose filter media in the annular space further comprises positioning the shroud, the loose filter media and the drainage layer on the base pipe after the forming.

32. The method of claim 28, wherein the loose filter media comprises sand.

33. The method of claim 28, wherein the loose filter media comprises proppant.

34. The method of claim 28, wherein the loose filter media comprises pieces of metal.

35. The method of claim 28, wherein the loose filter media comprises sandstone.

36. The method of claim 28, wherein the loose filter media comprises rubber.

37. The method of claim 28, wherein the loose filter media comprises a granular material.

38. The method of claim 28, wherein the loose filter media comprises interlocking shapes.

39. The method of claim 28, wherein the loose filter media comprises an aggregate material.

40. The method of claim 28, wherein the loose filter media comprises a composite material.

41. The method of claim 28, wherein the loose filter media is radially compressed between the shroud and the base pipe.

42. The method of claim 28, wherein the loose filter media is radially compressed between materials having different coefficients of thermal expansion.

43. The method of claim 28, wherein the loose filter media is radially compressed between the shroud and a drainage layer.

* * * * *